US006030176A

United States Patent [19]

Oeynhausen

[11] Patent Number: 6,030,176

[45] Date of Patent: Feb. 29, 2000

[54] STRUCTURAL MEMBER FOR AN EXHAUST-GAS CONNECTION OF A TURBOMACHINE, IN PARTICULAR A STEAM TURBINE, AND SET OF AT LEAST TWO STRUCTURAL MEMBERS

[75] Inventor: Heinrich Oeynhausen, Mülheim, Germany

[73] Assignee: Siemens Aktiengesellschaft, Munich, Germany

[21] Appl. No.: 09/009,560

[22] Filed: Jan. 20, 1998

Related U.S. Application Data

[63] Continuation of application No. PCT/DE96/01231, Jul. 8, 1996.

[30] Foreign Application Priority Data

Jul. 19, 1995 [DE] Germany ..... 195 26 392
Apr. 16, 1996 [DE] Germany ..... 196 15 011

[51] Int. Cl.[7] ..... F01D 25/24

[52] U.S. Cl. ..... 415/214.1; 415/111; 415/112; 415/142; 415/200; 415/175; 415/915

[58] Field of Search ..... 415/111, 112, 415/142, 200, 214.1, 175, 176, 915, 115

[56] References Cited

U.S. PATENT DOCUMENTS

| | | | |
|---|---|---|---|
| 2,414,814 | 1/1947 | Johnson . | |
| 2,859,935 | 11/1958 | Roesch . | |
| 3,949,147 | 4/1976 | Hawthorne | 428/446 |
| 4,156,342 | 5/1979 | Korta et al. | 60/39.08 |
| 4,183,207 | 1/1980 | Libertini . | |
| 4,245,951 | 1/1981 | Minnich | 415/139 |
| 4,304,522 | 12/1981 | Newland | 415/135 |
| 4,451,200 | 5/1984 | Libertini et al. . | |
| 5,080,555 | 1/1992 | Kempinger | 415/142 |

FOREIGN PATENT DOCUMENTS

| | | |
|---|---|---|
| 0 251 125 A1 | 1/1988 | European Pat. Off. . |
| 2 181 283 | 11/1973 | France . |
| 570 549 | 12/1975 | Switzerland . |
| 685 448 A5 | 7/1995 | Switzerland . |
| 940 195 | 10/1963 | United Kingdom . |
| 2 226 086 | 6/1990 | United Kingdom . |
| 2 281 592 | 3/1995 | United Kingdom . |

*Primary Examiner*—Edward K. Look
*Assistant Examiner*—Ninh Nguyen
*Attorney, Agent, or Firm*—Herbert L. Lerner; Laurence A. Greenberg

[57] ABSTRACT

A structural member is provided for an exhaust-gas connection of a turbomachine, in particular a steam turbine, and a turbomachine bearing disposed in the exhaust-gas connection. The structural member is cast in one piece and has a connection part and/or a bearing part for accommodating the bearing as well as a supporting arm configuration with at least one supporting arm. A pipe conduit which is cast into the structural member leads through a connection part, a supporting arm and a bearing part. A set of at least two such structural members form an exhaust-gas connection and a frame for the bearing of the turbomachine.

15 Claims, 5 Drawing Sheets

STRUCTURAL MEMBER FOR AN EXHAUST-GAS CONNECTION OF A TURBOMACHINE, IN PARTICULAR A STEAM TURBINE, AND SET OF AT LEAST TWO STRUCTURAL MEMBERS

CROSS-REFERENCE TO RELATED APPLICATION

This application is a continuation of International Application PCT/DE96/01231, filed Jul. 8, 1996, which designated the United States.

BACKGROUND OF THE INVENTION

Field of the Invention

The invention relates to a structural member for an exhaust-gas connection of a turbomachine and a turbomachine bearing disposed in the exhaust-gas connection. The invention also relates to a set of at least two structural members.

The invention relates in particular to an exhaust-gas connection for connecting a steam turbine to a condenser. The steam turbine expands the steam which serves as a fluidic medium, until the steam condenses. In particular, reference is made to an exhaust-gas connection which directs the steam flowing from the steam turbine essentially rectilinearly to the condenser. A configuration that is made in such a way and has a steam turbine, an exhaust-gas connection and a condenser, is constructed in particular for a steam turbine having a mechanical output of up to about 300 MW, as used in a combined-cycle power station. A combined-cycle power station is a power station in which mechanical output is produced both by a gas turbine and by a steam turbine, with exhaust gases from the gas turbine being used to prepare steam for the steam turbine. Within the scope of one embodiment which is of special interest in the market at present, the exhaust gas from the gas turbine is the sole heat source for preparing the steam.

According to conventional practice, an exhaust-gas connection of the type mentioned at the beginning is preferably made as a welded construction, i.e. it is welded together from appropriately formed steel plates. A frame for a bearing which is possibly required in the interior of the exhaust-gas connection is joined to the actual exhaust-gas connection through welded-in supports. Requisite feed lines and discharge lines for operating the bearing, in particular feed lines for lubricating oil, pressure oil, sealing steam and air as well as discharge lines for oil, oil mist and low-tension steam together with any requisite cables for electric and electronic components for monitoring and possibly controlling the bearing, must be run in separate pipe ducts from outside the exhaust-gas connection and through the exhaust-gas connection to the bearing. That necessitates complicated structures, since complete tightness is required between the interior space of the exhaust-gas connection, through which the condensing steam has to flow, and the bearing, in order to prevent oil or air from passing from the bearing into the condensing steam. That is because oil or air would considerably impair the thermodynamic process taking place in the steam turbine. For those reasons, the complicated structures resulting heretofore have a further disadvantage irrespective of whether the configurations of supporting arms, supports and pipe conduits are fitted like a lattice or in each case in a radial direction into the exhaust-gas connection. Those fitted components always impair the flow of the steam to a quite considerable extent and lead to back pressure at the outlet of the steam turbine being increased. The back pressure, inter alia, determines the output delivered by the steam turbine. The meaning thereof is that its output and its efficiency are adversely affected.

Swiss Patent CH 570 549 A5, corresponding to U.S. Pat. No. 4,076,452; Swiss Patent CH 685 448 A5; and U.S. Pat. No. 2,414,814, disclose exhaust-gas connections in welded and/or bolted form or in a form assembled in another way from individual parts.

Other disadvantages of the previous embodiments for exhaust-gas connections are the result of the high cost that is necessary for producing such exhaust-gas connections.

SUMMARY OF THE INVENTION

It is accordingly an object of the invention to provide a structural member for an exhaust-gas connection of a turbomachine, in particular a steam turbine, and a turbomachine bearing disposed in the exhaust-gas connection, as well as a set of at least two structural members, which overcome the hereinafore-mentioned disadvantages of the heretofore-known devices of this general type and in which the structural member can be produced at the lowest possible cost, requires only inexpensive materials, if possible, and utilizes available space as well as possible with regard to feed and discharge lines required for supplying the bearing, in order to impair a flow of fluidic medium as little as possible.

With the foregoing and other objects in view there is provided, in accordance with the invention, in an exhaust-gas connection of a turbomachine having a turbomachine bearing disposed in the exhaust-gas connection, a one-piece cast structural member for the exhaust-gas connection and the bearing, comprising a connection part and/or a bearing part for accommodating the bearing; a supporting-arm configuration having at least one supporting arm supporting the connection part and/or bearing part; as well as a pipe conduit surrounded by the supporting-arm configuration and leading through the connection part and/or bearing part and the supporting arm.

The structural member according to the invention is accordingly produced in one piece. It contains a part of the exhaust-gas connection and/or a part of a frame for the bearing, namely the bearing part, and at least one supporting arm which can support the bearing part (and subsequently the entire bearing) against the connection part or the entire exhaust-gas connection. A pipe conduit which is integrally formed in the supporting arm leads through the supporting arm and is therefore suitable as a feed line or discharge line for a fluid which has to be fed to or discharged from the bearing during operation. Depending on requirements, it is quite possible for a plurality of pipe conduits to be passed through a single supporting arm.

In accordance with another feature of the invention, the supporting-arm configuration in the structural member has two supporting arms, which improves the stability of the structural member and the exhaust-gas connection to be formed with this structural member.

The pipe conduit may be made in a supporting arm in various ways. In accordance with a further feature of the invention, the pipe conduit is a single pipe conduit formed of an individual pipe which is cast into the supporting arm. Such a single pipe conduit is preferred for transporting a fluid which is at a temperature approximately corresponding to the temperature of the fluidic medium flowing around the supporting arm, so that considerable stresses due to greatly varying temperatures need not be expected.

In accordance with an added feature of the invention, if a single pipe conduit is insufficient, there is provided an insulating pipe conduit formed of an outer pipe cast into the supporting arm and an inner pipe laid in the outer pipe and insulated from the latter. Such an insulating pipe conduit is especially suitable for transporting a fluid having a temperature which deviates substantially from the temperature of the structural member and the fluidic medium flowing around the latter.

An important application in this sense is the utilization of an insulating pipe conduit for feeding sealing steam to a shaft seal in front of the bearing in an exhaust-gas connection of a steam turbine. The sealing steam is fed to an allocated pipe conduit which makes the connection to the shaft seal in the exhaust-gas connection. In the same way, the so-called low-tension steam extraction is passed through an insulating pipe conduit through a supporting arm and connected by a pipe joint to the shaft seal. In general, the temperature of the sealing steam or low-tension steam is high in order to avoid undesirable condensation. For this reason, it is useful to thermally insulate the pipe conduit utilized for feeding the sealing steam or low-tension steam. This is preferably effected through the use of an insulating pipe conduit. The sealing steam or low-tension steam is passed through the inner pipe, and a space between the inner pipe and the outer pipe can be evacuated or thermally insulated in another way. If the exhaust-gas connection connects a steam turbine to a condenser, a very low pressure prevails in it during regular operation. It may therefore be sufficient for the desired insulation to merely connect the gap between the inner pipe and the outer pipe to the interior space of the exhaust-gas connection. A multiplicity of spacers are available in order to guarantee a gap between the inner pipe and the outer pipe in an insulating pipe conduit. Spacers may be separate structural members, for example stars, which are pushed onto the inner pipe before the latter is pushed into the outer pipe. It is also conceivable to provide the inner pipe with ribs on the outside and/or the outer pipe with ribs on the inside, which hold the outer pipe and the inner pipe at a distance from one another. The use of ceramic spacers is likewise possible. If need be the gap may also be filled with an insulating material.

In accordance with an additional feature of the invention, the structural member has a connection part and a casing part attached thereto for a casing of the turbomachine. In this manner, the layout as well as construction of the turbomachine and its exhaust-gas connection can be substantially simplified.

In accordance with yet another feature of the invention, the structural member may also have a bearing part for the bearing of the turbomachine, if need be in addition to a connection part as described. The structure of the bearing would thus be integrated in the concept representing the invention, which results in additional advantages.

In accordance with yet a further feature of the invention, the material of the structural member of each configuration is a cast iron material, with special preference being given to so-called "spheroidal-graphite cast iron". Spheroidal-graphite cast iron is a cast iron material which is distinguished in the solid state by approximately spherical separations of graphite in a metallic matrix. Thus it differs from the normal cast iron, which has flake-shaped separations of graphite. Spheroidal-graphite cast iron is an appropriately known material, which is distinguished by both good castability and good machinability. A structural member made of spheroidal-graphite cast iron can be machined with little effort so that a predetermined dimensional accuracy, that cannot be guaranteed within the limits of a conventional casting process, can be achieved at contact surfaces to which other components have to be attached.

In accordance with yet an added feature of the invention, the pipe conduit is made of a steel, which is of importance in particular in connection with the selection of spheroidal-graphite cast iron as the material for the rest of the structural member. The term "steel" should be interpreted at this point in accordance with its most general meaning. Accordingly, steel is a ferrous material which, as compared with a cast iron material, is distinguished by a significantly lower content of carbon, and clearly higher ductility associated therewith, as well as a substantially higher melting point. In general, a steel only melts at a temperature about 200° C. higher than a cast iron material. The meaning of this is that a steel pipe does not melt if it is cast into a structural member, i.e. if it is fitted into the mold intended for casting the structural member and the liquid cast iron material is cast around it. Any impaired dimensional stability due to the still quite high temperature to which the pipe is exposed can be counteracted by the pipe being filled with sand or another suitable filler, in particular a filler which can be melted out subsequently. In this connection, the question as to whether or not the cast iron material being used and the steel being used contain certain alloying elements is not important. This can be decided with respect to the intended purpose of the cast iron material and the steel according to the relevant estimation of the person skilled in the art.

In accordance with yet an additional feature of the invention, the connection part has a flat side where it is joined together with a connection part of another structural member for producing an exhaust-gas connection, with the flat side lying in a plane which contains a rotation axis of the turbomachine. In particular, the structural member is thus a half shell for the exhaust-gas connection, which accordingly is to be formed with two structural members to be placed one on top of the other at corresponding flat sides.

With the objects of the invention in view, there is also provided a set of at least two structural members which meet the above-mentioned requirements and each of which has a connection part, and the connection parts forming an exhaust-gas connection.

Accordingly, there is provided a set of at least two structural members for an exhaust-gas connection of a turbomachine and a turbomachine bearing disposed in the exhaust-gas connection according to the invention, wherein each structural member in each case is cast in one piece and has a connection part as well as a supporting-arm configuration and a pipe conduit that leads through a connection part and a supporting arm, and the connection parts form an exhaust-gas connection closed around a rotation axis of the turbomachine.

All of the explanations with regard to the advantages which can be achieved with the aid of a single structural member and all of the information which relates to advantageous refinements of an individual structural member also apply by analogy to the set of at least two structural members according to the invention.

In accordance with another feature of the invention, the set includes a bottom structural member having two vertically inclined supporting arms disposed symmetrically to one another relative to a vertically oriented vertical axis, and a top structural member disposed vertically above the bottom structural member and having a vertically oriented supporting arm.

In accordance with a further feature of the invention, the bottom structural member has a third vertically running supporting arm. Such a configuration having three or four supporting arms ensures especially effective support of the bearing laterally and vertically relative to the rotation axis of the turbomachine.

The third supporting arm helps to support the bearing and is especially suitable for an integrally cast pipe conduit, which may be a single pipe conduit and through which lubricating oil may be discharged from or fed to the bearing. In connection with a turbomachine, a plain bearing is normally used, which requires oil to be fed in considerable quantity in order to operate it. The oil escapes from the bearing along the mounted shaft and must be discharged speedily and without the oil accumulating, otherwise there is the risk of a pressure buildup in the bearing housing and of the function being impaired. Such a speedy discharge of the oil is assisted if it takes place through a vertical pipe conduit while utilizing the force of gravity.

In accordance with an added feature of the invention, the bottom structural member has a bottom connection part and a bottom bearing part, the top structural member has a top connection part, and a center structural member is provided which has a top bearing part, the bottom bearing part being connected to the top bearing part, and the center structural member being connected to the top structural member at a disconnecting point in a supporting arm.

Since a frame for the bearing is formed only with the bottom and the center structural member within the scope of this embodiment of the invention, the top structural member can be removed from the set, that is the exhaust-gas connection can be opened, without having to open the frame for the bearing in the process. The bearing is therefore easily accessible without it having to be dismantled for this purpose, and a simple way of carrying out an operational check and an inspection is obtained.

In accordance with a concomitant feature of the invention, the set of at least two structural members according to the invention forms an exhaust-gas connection for a steam turbine, as already indicated repeatedly above. Such an exhaust-gas connection is distinguished by especially effective utilization of the available space and it requires no separate fitted components in order to supply the bearing in the exhaust-gas connection with the requisite operating media.

Other features which are considered as characteristic for the invention are set forth in the appended claims.

Although the invention is illustrated and described herein as embodied in a structural member for an exhaust-gas connection of a turbomachine, in particular a steam turbine, and a set of at least two structural members, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
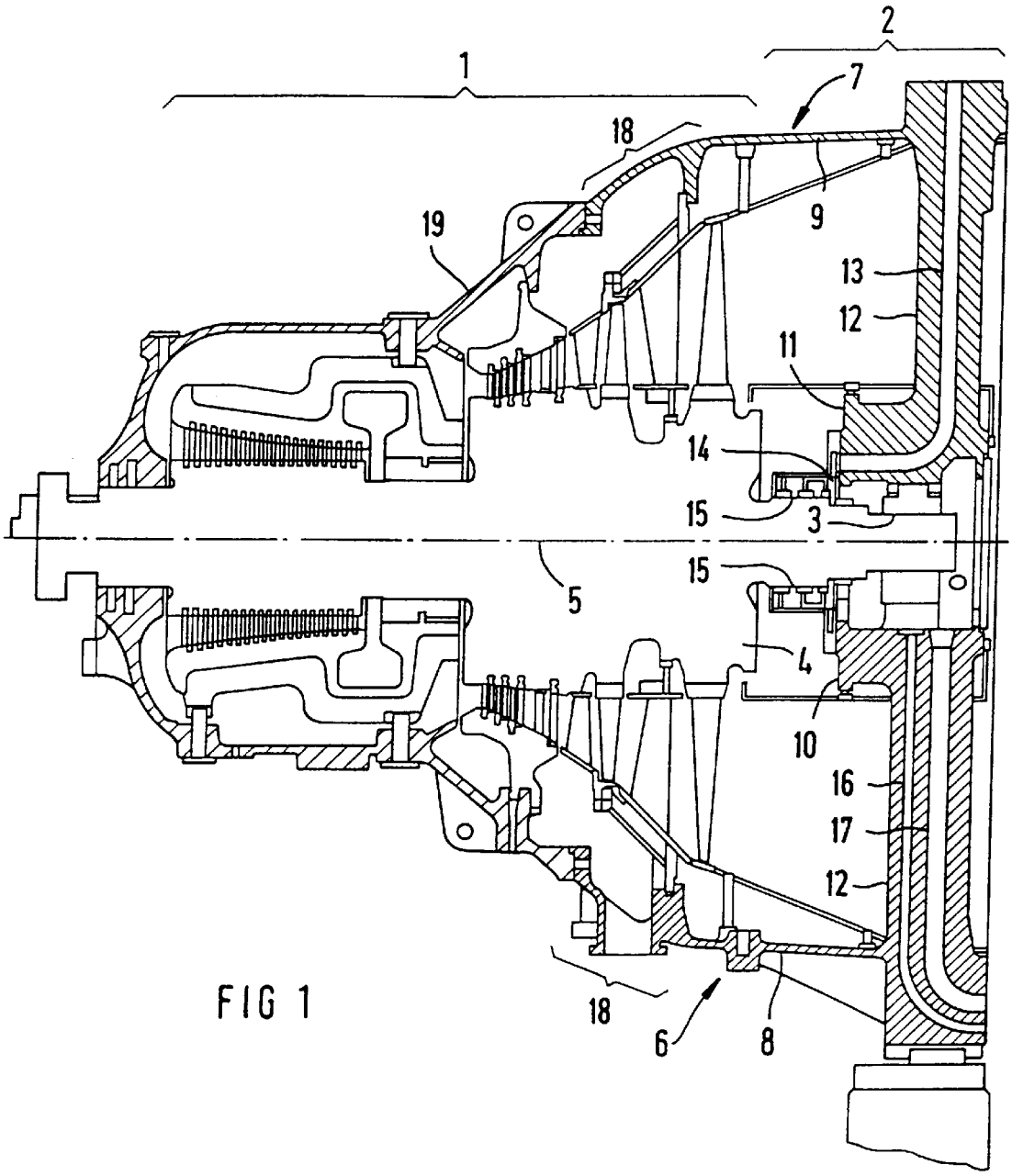
FIG. 1 is a fragmentary, diagrammatic, longitudinal-sectional view of a steam turbine together with an associated exhaust-gas connection.

Referring now in detail to the figures of the drawings, it is seen that since FIGS. 1 to 5 and 6 to 8 show various sections or partial views of exemplary embodiments, corresponding reference numerals appear in the figures. For this reason, the following explanations are always jointly related to all associated figures, although special reference is made with the aid of each figure to those features which can be recognized especially clearly with the aid of that figure.

FIG. 1 shows a turbomachine 1, namely a steam turbine, having an associated exhaust-gas connection 2 through which steam that has been expanded in the steam turbine 1 is fed to a condenser. A bearing 3 for a rotor 4 of the steam turbine 1 is disposed in the exhaust-gas connection 2. The rotor 4 is rotatable about a rotation axis 5 and rotates about this rotation axis 5 during continuous operation. The exhaust-gas connection 2 has a bottom structural member 6 and a top structural member 7. Each structural or construction member 6, 7 has a respective connection part 8, 9 which forms the actual exhaust-gas connection 2 with the connection part 8, 9 of the other respective structural member 6, 7. In addition, each structural member 6, 7 has an associated respective bearing part 10, 11. The two bearing parts 10, 11 form a frame for the actual bearing 3. Certain details of the bearing 3 and of the sealing configuration belonging to the bearing 3 which can be recognized from FIG. 1 are well known to the person skilled in the art and therefore they are not discussed thoroughly herein for the sake of clarity. Each structural member 6, 7 has a vertical supporting arm 12 which connects the respective connection part 8, 9 to the respective bearing part 10, 11. The structural members 6, 7 are made in one piece and specifically they are each cast from spheroidal-graphite cast iron. The vertical supporting arm 12 of the top structural member 7 has a single pipe conduit which is formed of an individual pipe 13 cast into the supporting arm 12. The top bearing part 11 is cast in one piece with the supporting arm 12. The single pipe 13 located therein serves to feed air into an intermediate space 14 between a shaft seal 15 and the bearing parts 10 and 11. The vertical supporting arm 12 of the bottom structural member 6 has two individual pipe conduits 16 and 17. Each individual pipe conduit is formed in turn of an individual pipe 16, 17 cast into the supporting arm 12. A casing part 18 which encloses part of the steam turbine 1 and forms a connection for a remaining casing 19 of the steam turbine 1, is integrally formed on each connection part 8, 9.

Figure 2:
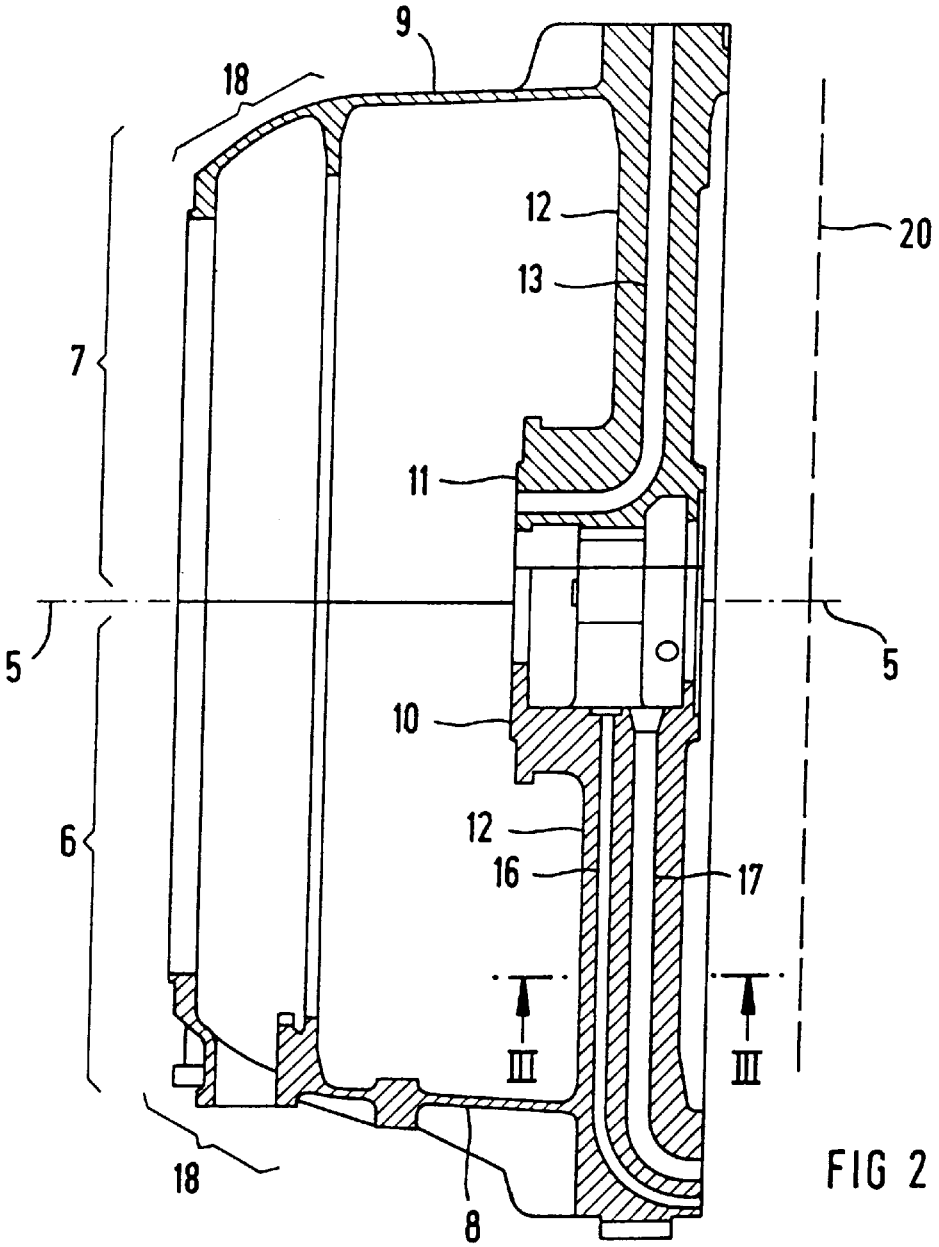
FIG. 2 is a longitudinal-sectional view of the exhaust-gas connection including part of a casing of the steam turbine by itself.

FIG. 2 shows the structural members 6 and 7 without the front part of the steam turbine and its further components. The connection parts 8 and 9, the vertical supporting arms 12 and the bearing parts 10 and 11 are clearly recognizable. In the present exemplary embodiment, a respective connection part 8, 9 and a respective casing part 18 in each case form a unit in which there is no sharp transition between the connection part 8, 9 and the casing part 18. This transition is determined essentially by the casing 19 of the steam turbine 1 to be attached or installed. A vertical axis 20 is drawn for defining the direction of the vertical in FIG. 2 to illustrate that the longitudinal section which is recognizable from FIG. 2 is a section in a vertical plane.

Figure 3:
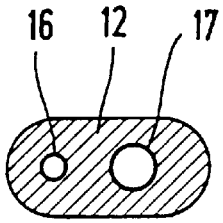
FIG. 3 is a cross-sectional view taken along a line III—III of FIG. 2, in the direction of the arrows, through one of the supporting arms shown in FIG. 2.

FIG. 3 shows a section through the vertical supporting arm 12 of the bottom structural member 6, as is indicated by the line III—III in FIG. 2. The pipes 16 and 17 which are cast into the supporting arm 12 are clearly recognizable. The pipes 16 and 17 have a different cross-sectional area and are respectively used in particular for oil discharge and oil feed.

Figure 4:
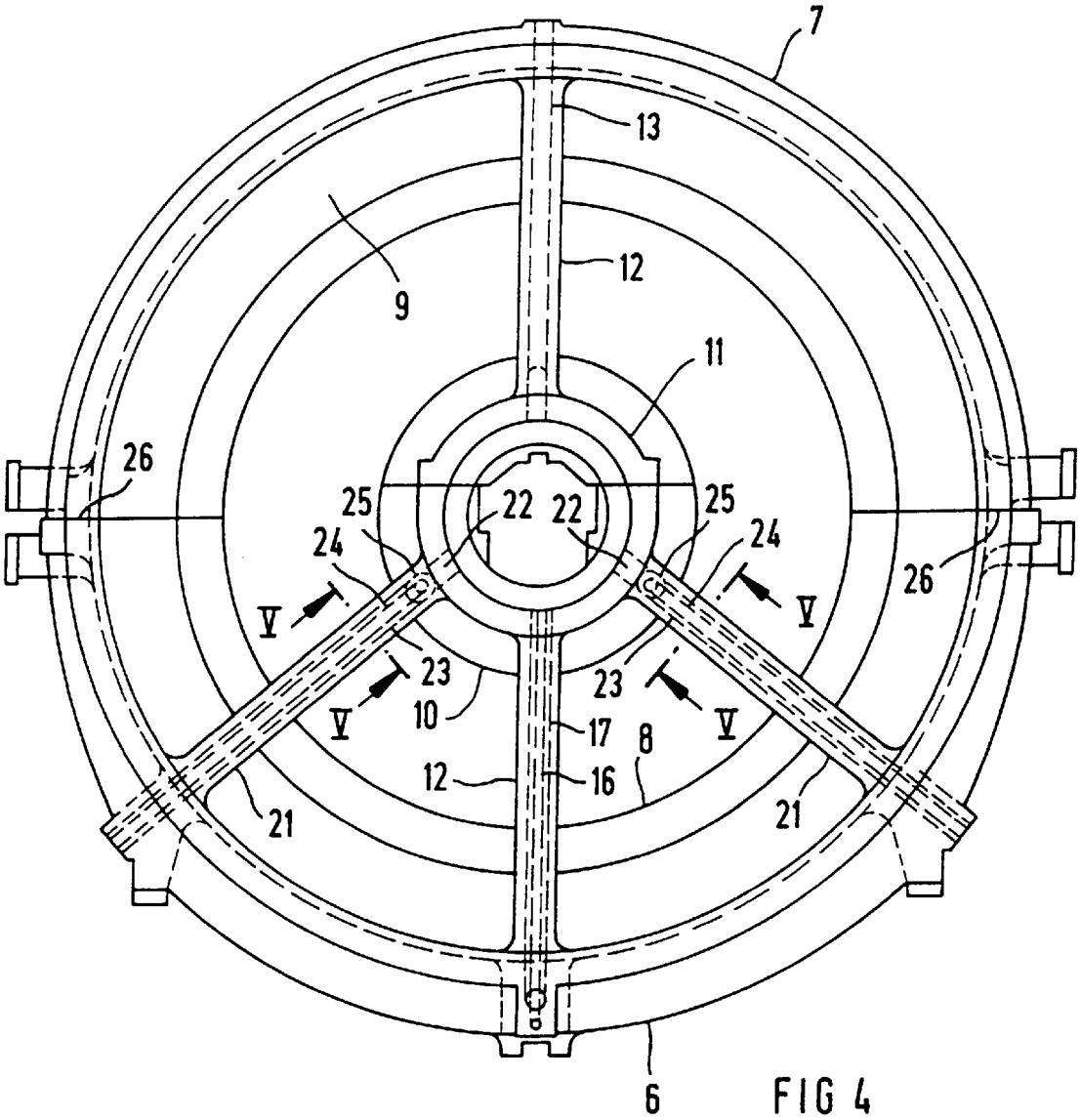
FIG. 4 is a cross-sectional view through the exhaust-gas connection according to FIG. 3.

FIG. 4 shows a cross-section, which in particular is taken along the vertical axis 20, through the exhaust-gas connection according to FIG. 2. The bottom structural member 6 and the top structural member 7 with their respective connection parts 8 and 9, their respective bearing parts 10 and 11 and their respective vertical supporting arms 12, are again clearly recognizable. A single pipe conduit 22 which extends right into the bottom bearing part 10 as well as an insulating pipe conduit 23, 24 which leads into a pipe conduit 25 leading to the shaft seal 15, in each case are run in supporting arms 21 that are inclined relative to the vertical axis 20. The insulating pipe conduits 23, 24 serve to carry sealing and/or low tension steam. The bottom structural member 6 has two inclined supporting arms 21 disposed symmetrically relative to the vertical axis 20. The connection parts 8, 9 of the structural members 6 and 7 are joined together at flat sides 26 that define a plane (apparent in particular from FIG. 1) in which the rotation axis 5 of the steam turbine 1 lies (this is revealed by FIG. 1). The connection parts 8 and 9 are therefore half shells of the exhaust-gas connection 2. The structural members 6 and 7 are preferably joined together through the use of bolts so that they can be released from one another in order to inspect the steam turbine 1 or the like.

An insulating pipe conduit 23, 24 is made with an outer pipe 23 cast into the inclined supporting arm 21 and with an inner pipe 24 laid in an insulating manner in the outer pipe 23. Provisions for keeping the inner pipe 24 at a distance from the outer pipe 23 are not shown for the sake of clarity, although details are apparent from FIG. 5. All of the pipes 13, 16, 17, 22, 23, 24 are made of steel. They are integrally cast by being fitted into an associated casting mold before the casting of the structural member 6 or 7 and by being encased by molten cast iron material during the casting. Since the melting point of a steel is normally distinctly higher than the melting point of a cast iron material, the pipes 13, 16, 17, 22, 23, 24 do not melt during this procedure. In order to prevent them from bending or from becoming distorted in another way, they are filled with a suitable filler material, in particular sand, before the casting. All known molding and casting processes are suitable for the casting of the structural members 6, 7. The most cost-effective and therefore preferred process is the sand casting process, i.e. the casting mold is formed with sand and the cast iron material is poured into the casting mold which is thus formed.

Figure 5:
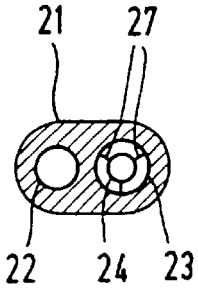
FIG. 5 is a cross-sectional view taken along lines V—V of FIG. 4, in the direction of the arrows, through one of the inclined supporting arms in FIG. 4.

FIG. 5 shows a cross-section through one of the inclined supporting arms 21 that is shown in FIG. 4. The section plane is indicated in FIG. 4 by the lines V—V. Each inclined supporting arm 21 has an integrally cast single pipe conduit 22 and an integrally cast-insulating pipe conduit 23, 24. Spacers 27 for keeping the inner pipe 24 at a distance from the outer pipe 23 are also apparent from FIG. 5.

All of the insulating pipe conduits 23, 24 are eminently suitable for feeding hot fluids to the shaft seal 15 or for discharging hot fluids from the shaft seal 15. Such hot fluids are, for example, steam which is fed to the bearing for sealing purposes, and low-tension steam, that is steam which leaks out of the bearing, is possibly contaminated with air and/or oil mist and has to be discharged. During operation, the exhaust-gas connection 2 and its structural members 6 and 7 reach temperatures around 50° C., in particular between 40° C. and 60° C. On the other hand, hot steam which flows towards the bearing 3 or away from the bearing 3 has a temperature around about 200° C., in particular between 150° C. and 250° C. Due to the fact that such steam is carried in an inner pipe 24 of an insulating pipe conduit 23, 24, the temperature of the corresponding supporting arm 21 stays close to the temperature of the other components of the exhaust-gas connection 2 and in particular heats up at most by 10° C. The occurrence of mechanical stresses is thereby reliably prevented.

Figure 6:
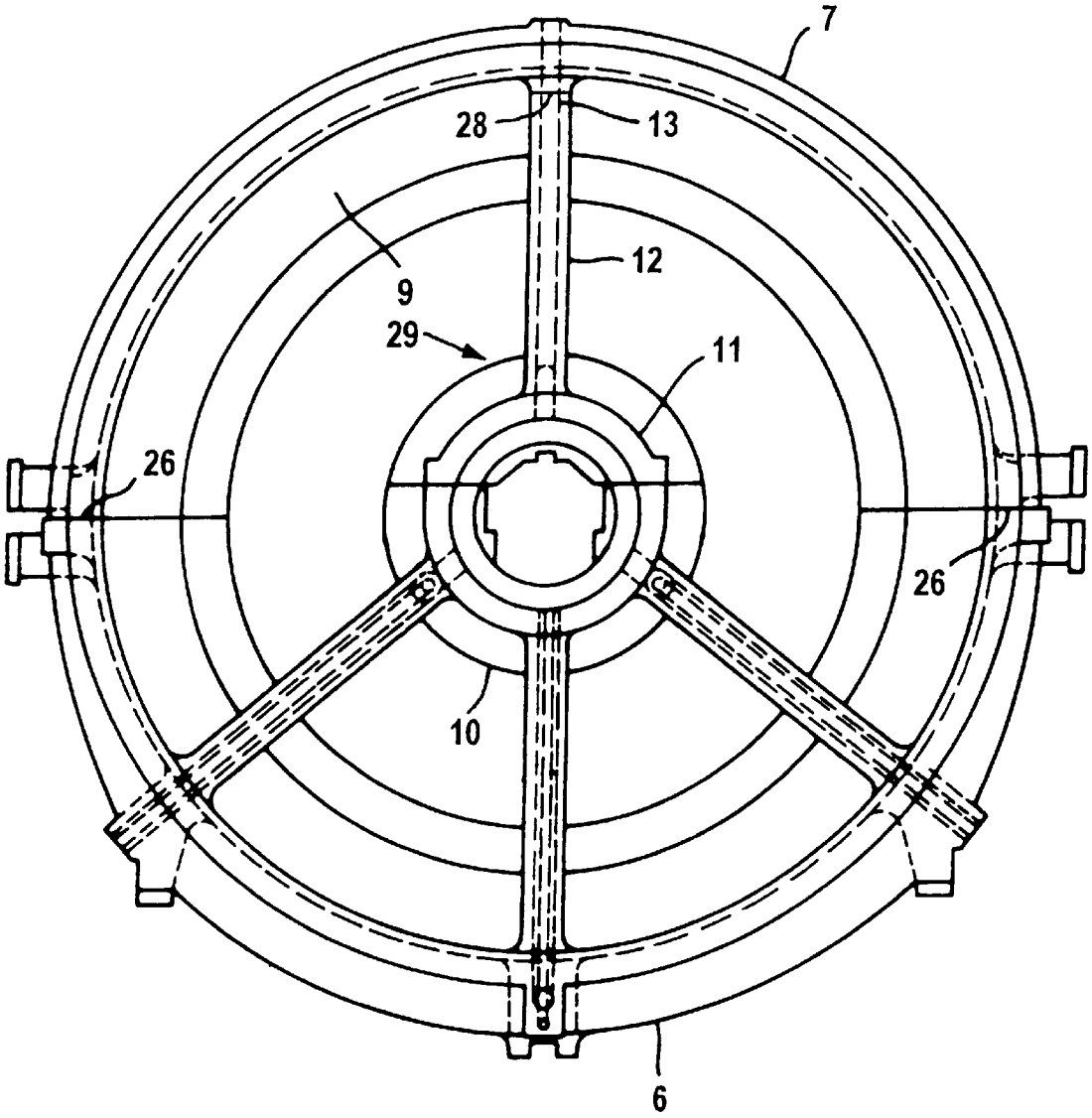
FIG. 6 is a cross-sectional view through a somewhat modified exhaust-gas connection having three structural members.

Air is preferably passed through the pipe conduit 13 in the top vertical supporting arm 12 into the intermediate space 14 between the shaft seal 15 and the bearing 3. Additional pipes in the interior of the exhaust-gas connection 2 are no longer necessary due to the presence of a corresponding number of pipe conduits 13, 22, 23, 24. Furthermore, all of the pipes 13, 22, 23, 24 which connect the bearing 3 to devices outside the actual steam turbine are completely integrally cast and are therefore encased by the material of the structural members 6 and 7. There are no exposed connecting points such as flanges or sleeves. Leakages from a pipe 13, 22, 23, 24 containing oil or oil mist are therefore completely impossible. Any leakages from the connecting points of the insulating pipes 23, 24 to the pipe conduits 25 of the shaft seals 15 are unproblematic, since only steam or vapors can escape. The flow resistance which the exhaust-gas connection 2 sets up against a fluidic medium flowing through is also low by virtue of the rounded construction of the supporting arms 12 and 21. Therefore, impaired operation of the steam turbine 1 need not be expected at all. Like FIG. 2, FIG. 6 shows a cross-section through an exhaust-gas connection which, as compared with the exhaust-gas connection discernible from FIG. 5, is distinguished by the fact that it is not formed of two but rather three structural members 6, 7 and 29. A center structural member 29 which has the top bearing part 11 and the largest part of the vertical supporting arm 12 between the top bearing part 11 and the top connection part 9, is added to the bottom structural member 6, unaltered with respect to FIG. 5, and a top structural member 7 which merely carries the top connection part 9 as well as part of the corresponding vertical supporting arm 12. The top structural member 7 and the center structural member 29 meet at a disconnecting location 28 in the supporting arm 12 to which reference was made. Actually, it may still be said that the top structural member 7 includes a supporting arm 12. In any case, it has an extension of this supporting arm 12. Details of the allocation of the supporting arm 12 to the top structural member 7 and the center structural member 29 are to be established according to the requirements of the particular individual case. The configuration according to FIG. 6 always has the advantage that the top bearing part 11 need not necessarily be removed during dismantling. The bearing 3 of the steam turbine 1 can remain unchanged and is accessible for simple checking or inspection after removal of the top structural member 7. The frame for the bearing 3 can also be assembled in a substantially simpler manner without the top connection part 9 having to be manipulated at the same time with the top bearing part 11.

Figure 8:
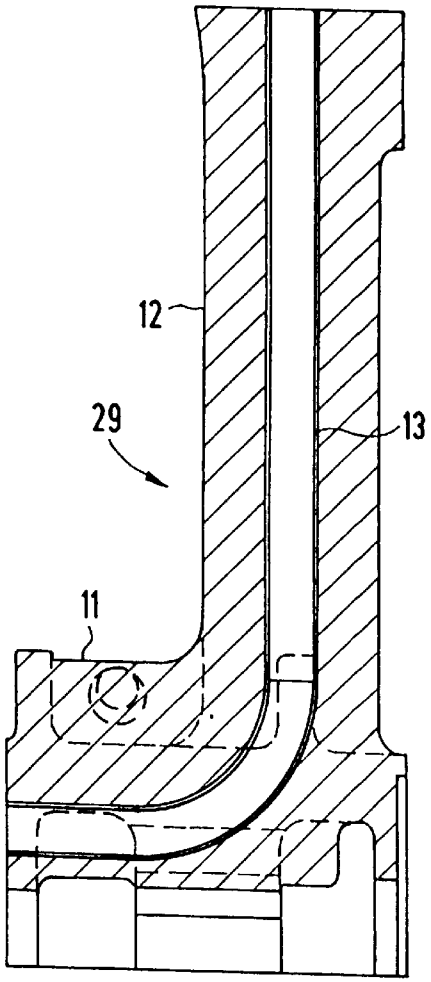
FIG. 7 and FIG. 8 are respective enlarged, longitudinal-sectional and cross-sectional views of a center structural member of the exhaust-gas connection according to FIG. 6.
Figure 7:
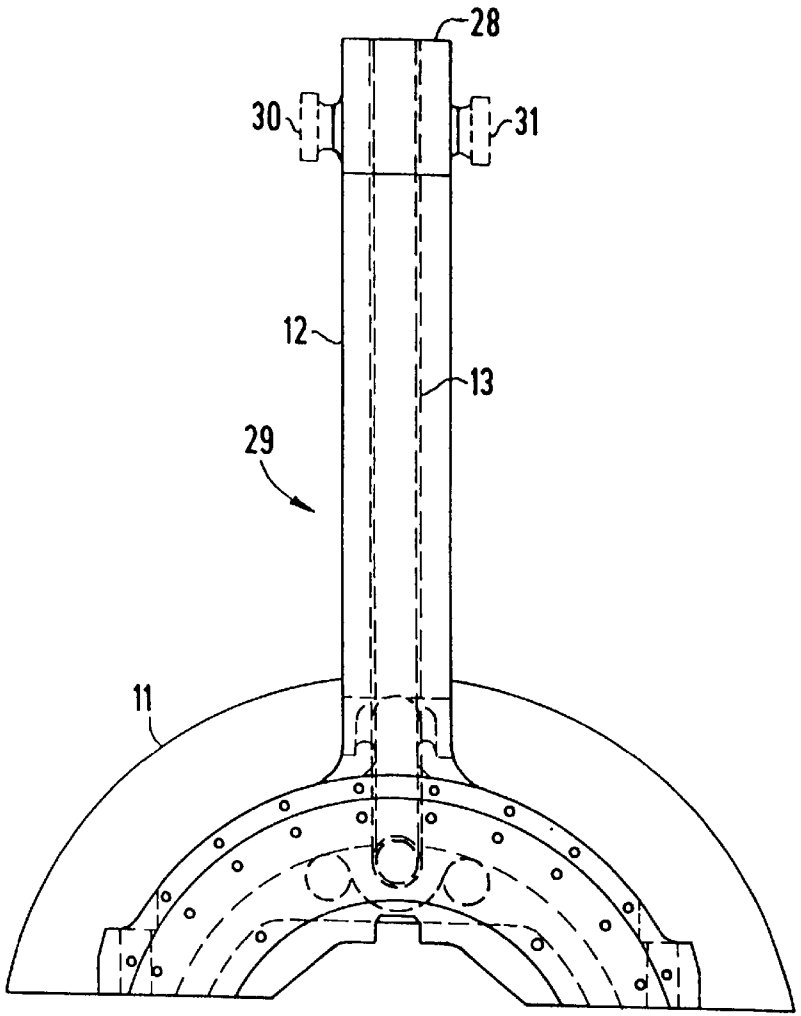

FIGS. 7 and 8 show mutually orthogonal, longitudinal sections through the center structural member 29. The top bearing part 11, the vertical supporting arm 12 which is partly present and has an integrally cast single pipe conduit 13, as well as (in FIG. 7) holding devices 30 and 31, which may be useful for manipulating the center structural member 29 or for fastenings, can be recognized.

The invention relates to a structural member for an exhaust-gas connection of a turbomachine, in particular a steam turbine. The structural member contains any necessary pipe conduits as integral components and can be cast in one piece. The cost of manufacture for such a structural member is distinctly reduced as compared with the conventional welding technique. Space can also be saved to a considerable extent by an appropriate configuration of the pipe conduits to be provided. This may be of importance for the operation of the turbomachine, since space which becomes free is available for the fluidic medium flowing off from the turbomachine, as a result of which a pressure loss across the exhaust-gas connection when the fluidic medium flows through is reduced. This directly results in a thermodynamic advantage. The invention also relates to a set of several such structural members, wherein the exhaust-gas connection is formed entirely from these structural members. The advantages referred to arise particularly for such an exhaust-gas connection.

I claim:

1. In an exhaust-gas connection of a turbomachine having a turbomachine bearing disposed in the exhaust-gas connection, a structural member, comprising:

a one-piece cast member for the exhaust-gas connection and the bearing having:

at least one of a connection part and a bearing part for accommodating the bearing;

a supporting-arm configuration having at least one supporting arm supporting said at least one part; and a pipe conduit surrounded by said supporting-arm configuration and leading through said at least one part and said supporting arm.

2. The structural member according to claim 1, wherein said supporting-arm configuration has at least two supporting arms.

3. The structural member according to claim 1, wherein said supporting-arm configuration has a supporting arm into which a single pipe conduit formed of an individual pipe is cast.

4. The structural member according to claim 1, wherein said supporting-arm configuration has a supporting arm with an insulating pipe conduit formed of an outer pipe cast into said supporting arm and an inner pipe laid in and insulated from said outer pipe.

5. The structural member according to claim 1, wherein said one-piece cast member includes a casing part attached to said connection part for attaching to a casing of the turbomachine.

6. The structural member according to claim 1, wherein said one-piece cast member is made of a cast-iron material.

7. The structural member according to claim 1, wherein said cast-iron material is spheroidal-graphite cast iron.

8. The structural member according to claim 1, wherein said pipe conduit is produced from a steel.

9. The structural member according to claim 1, wherein said connection part has a flat side to be joined together with a connection part of another structural member, said flat side defining a plane containing a rotation axis of the turbomachine.

10. In an exhaust-gas connection of a turbomachine having a rotation axis and a turbomachine bearing disposed in the exhaust-gas connection, a structure member, comprising:

a set of at least two one-piece cast structural members joined to one another for the exhaust-gas connection and the bearing, each structural member of said set of at least two one-piece cast structural members having:

a connection part;

a supporting-arm configuration having at least one supporting arm supporting said connection part; and a pipe conduit surrounded by said supporting-arm configuration and leading through said connection part and said supporting arm;

said connection parts of said set of at least two one-piece cast structural members forming the exhaust-gas connection closed around the rotation axis.

11. The structure member according to claim 10, wherein each structural member of said set of at least two one-piece cast structural members includes a bearing part for accommodating the bearing.

12. The structure member according to claim 10, wherein said set of at least two one-piece cast structural members includes a bottom structural member having two vertically inclined supporting arms disposed symmetrically to one another relative to a vertically oriented vertical axis as well as a top structural member disposed vertically above said bottom structural member and having a vertically oriented supporting arm.

13. The structure member according to claim 12, wherein said bottom structural member additionally has a vertically oriented supporting arm.

14. The structure member according to claim 12, wherein said set of at least two one-piece cast structural members includes a center structural member having a top bearing part, said bottom structural member having a bottom connection part and a bottom bearing part, said top structural member having a top connection part, said bottom bearing part connected to said top bearing part, and said center structural member connected to said top structural member at a disconnecting point in a supporting arm.

15. The structure member according to claim 10, wherein the exhaust-gas connection is an exhaust-gas connection for a steam turbine.

* * * * *